US006532674B2

(12) United States Patent
Farese

(10) Patent No.: US 6,532,674 B2
(45) Date of Patent: Mar. 18, 2003

(54) MARKING TOOL FOR FINISH CARPENTRY

(76) Inventor: Blaise Farese, 845 Berkshire Rd., Wingdale, NY (US) 12594

( * ) Notice: Subject to any disclaimer, the term of this patent is extended or adjusted under 35 U.S.C. 154(b) by 21 days.

(21) Appl. No.: 09/811,630

(22) Filed: Mar. 20, 2001

(65) Prior Publication Data

US 2002/0133957 A1 Sep. 26, 2002

(51) Int. Cl.[7] ..... E04F 21/00
(52) U.S. Cl. ..... 33/194; 33/42
(58) Field of Search ..... 33/194, 197, 613, 33/645, 479, 481, 562, 567

(56) References Cited

U.S. PATENT DOCUMENTS 4,273,016 A * 6/1981 Murdock ..... 33/194
4,813,826 A * 3/1989 Riedel ..... 33/197
4,984,613 A * 1/1991 Szeto et al. ..... 33/197
4,989,336 A 2/1991 Waltrip, Jr. et al.
5,123,172 A 6/1992 Thrun
5,737,172 A 4/1998 Brumley
6,145,206 A * 11/2000 Piccirillo ..... 33/194
6,230,413 B1 * 5/2001 Reiley ..... 33/194
6,305,091 B1 * 10/2001 Tegels ..... 33/197
6,341,427 B1 * 1/2002 Tepley ..... 33/194

* cited by examiner

*Primary Examiner*—Diego Gutierrez
*Assistant Examiner*—Yaritza Guadalupe
(74) *Attorney, Agent, or Firm*—Richard C. Litman

(57) ABSTRACT

A marking and positioning or checking tool for finish carpentry to obtain correct reveals, particularly for wooden trim around windows and doors. The tool of the present invention is a handheld, preferably plastic device that assists carpenters in maintaining the reveals around windows and doors accurate relative to the jambs. To accommodate different jobs, the marking tool has predetermined measuring or marking edges and can be made in differing sizes to meet the specific needs of a particular job. The marking tool is sufficiently compact to readily fit inside a carpenter's pouch.

9 Claims, 4 Drawing Sheets

MARKING TOOL FOR FINISH CARPENTRY

BACKGROUND OF THE INVENTION

1. Field of the Invention

The present invention generally relates to geometric instruments. More particularly, the invention is a marking tool to mark materials for cutting or positioning, specifically for assisting carpenters in keeping the reveals around windows and doors accurate.

2. Description of the Related Art

The accurate positioning of reveals around windows and doors is a common task in the house construction industry. A tool which is inexpensive, compact and convenient to use, and of a size to fit in a small pouch carried by the trim carpenter is desirable. Such a tool would be helpful to homeowners who do not have sufficient experience in installing trim, and would result in a more professional result.

U.S. Pat. No. 4,989,336, issued Feb. 5, 1991, to Waltrip, Jr. et al., describes a trim positioning device for trim strips and stop strips during the installation of wooden door frames in residential and commercial construction. The device includes a trim guide portion, a door frame guide, and a trim headpiece length marking piece. Several individual pieces of the device may be molded, extruded, or formed as a unitary piece.

U.S. Pat. No. 5,123,172, issued Jun. 23, 1992, to Thrun, describes a spacing gauge for molding and trim that is useful for the marking and installation of molding and trim around structural framed openings such as doors and windows. The gauge is unitary in design with two plates extending from a common right angle. The gauge may be equipped with a securing arm(see column 3, lines 11–20). The Thrun device as seen in FIG. 1, lacks notches at its opposite ends at the point of extension from the common right angle. The Thrun device, as a result, cannot be rotated around its longer axis to mark or check a reveal along a lintel at multiple points while providing a guiding surface of substantial length to insure squareness of the tool to the lentil.

U.S. Pat. No. 5,737,844, issued Apr. 14, 1998, to Brumly, describes a trim gauge for aiding in the installation and trimming of building windows and doors.

None of the above inventions and patents, taken either singularly or in combination, is seen to describe the instant invention as claimed. Thus, a marking tool for finish carpentry solving the aforementioned problems is desired.

SUMMARY OF THE INVENTION

The present invention is a marking and positioning tool to mark materials for cutting or for positioning, particularly wooden trim around windows and doors. The tool of the present invention is a handheld, preferably plastic device that assists carpenters in maintaining the reveals around windows and doors accurate relative to the jambs. To accommodate different jobs, the marking tool has predetermined measuring or marking edges and can be made in differing sizes to meet the specific needs of a particular job. The marking tool is sufficiently compact to readily fit inside a carpenter's pouch.

Accordingly, it is a principal object of the invention to provide a tool for carpenters in maintaining the reveals around windows and doors accurate, relative to the jambs.

It is another object of the invention to provide a tool as above which is hand held and easily used.

It is a further object of the invention to provide a tool as above which has predetermined measuring or marking edges and that can be made in differing sizes to meet the specific needs of a particular job.

Still another object of the invention is to provide a tool as above which has a plurality of differing length portions to allow the marking or checking of reveals of differing proportions.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a marking and positioning tool to mark materials for cutting or for positioning, particularly wooden trim around windows and doors. The tool of the present invention is a handheld, preferably plastic device that assists carpenters in maintaining the reveals around windows and doors accurate relative to the jambs. To accommodate different jobs, the marking tool has predetermined measuring or marking edges and can be made in differing sizes to meet the specific needs of a particular job. The marking tool is sufficiently compact to readily fit inside a carpenter's pouch.

Figure 1:
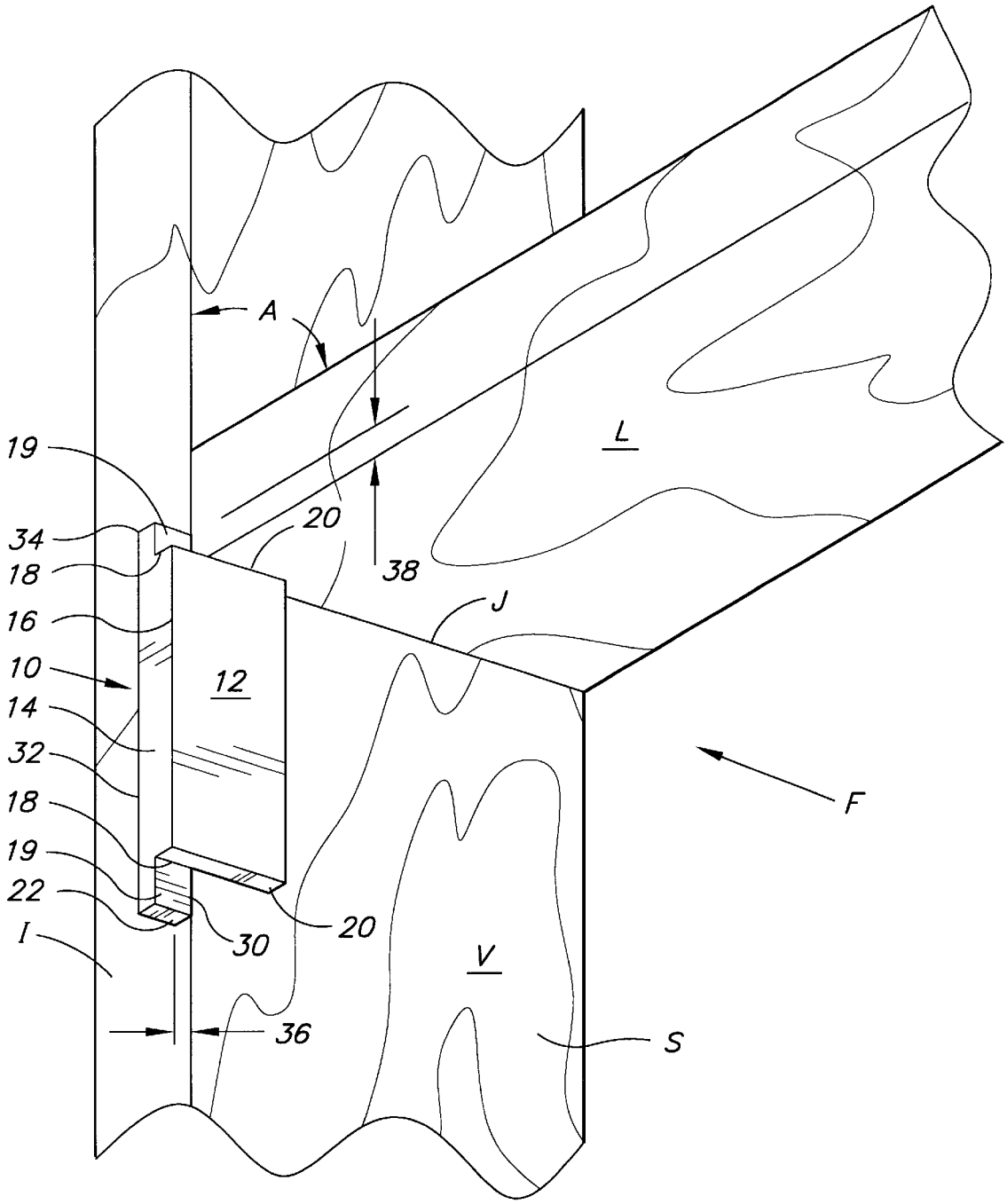
FIG. 1 is an environmental, perspective view of a marking tool for finish carpentry according to the present invention.
Figure 2:
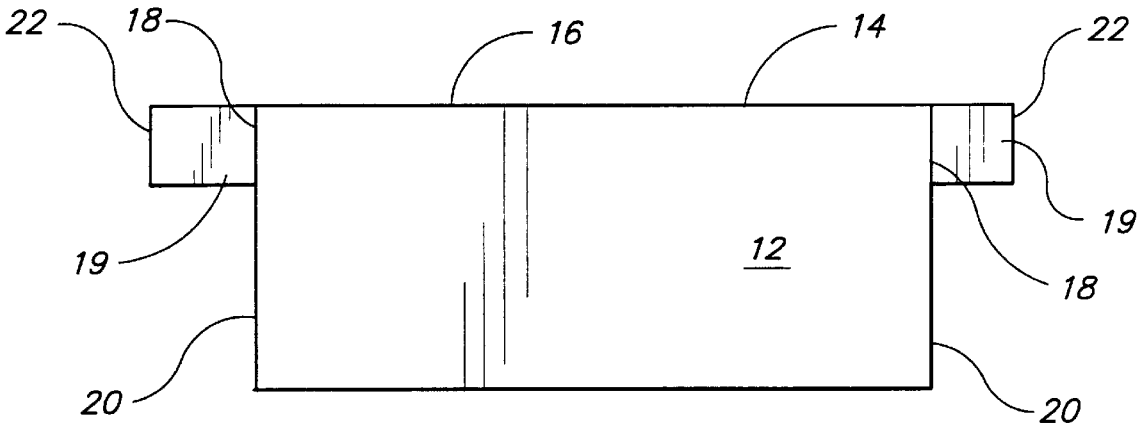
FIG. 2 is a front elevation view of the tool of FIG. 1.
Figure 3:
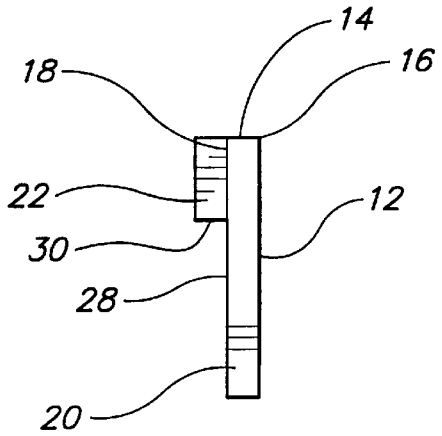
FIG. 3 is a side elevation view of the tool of FIG. 1.
Figure 4:
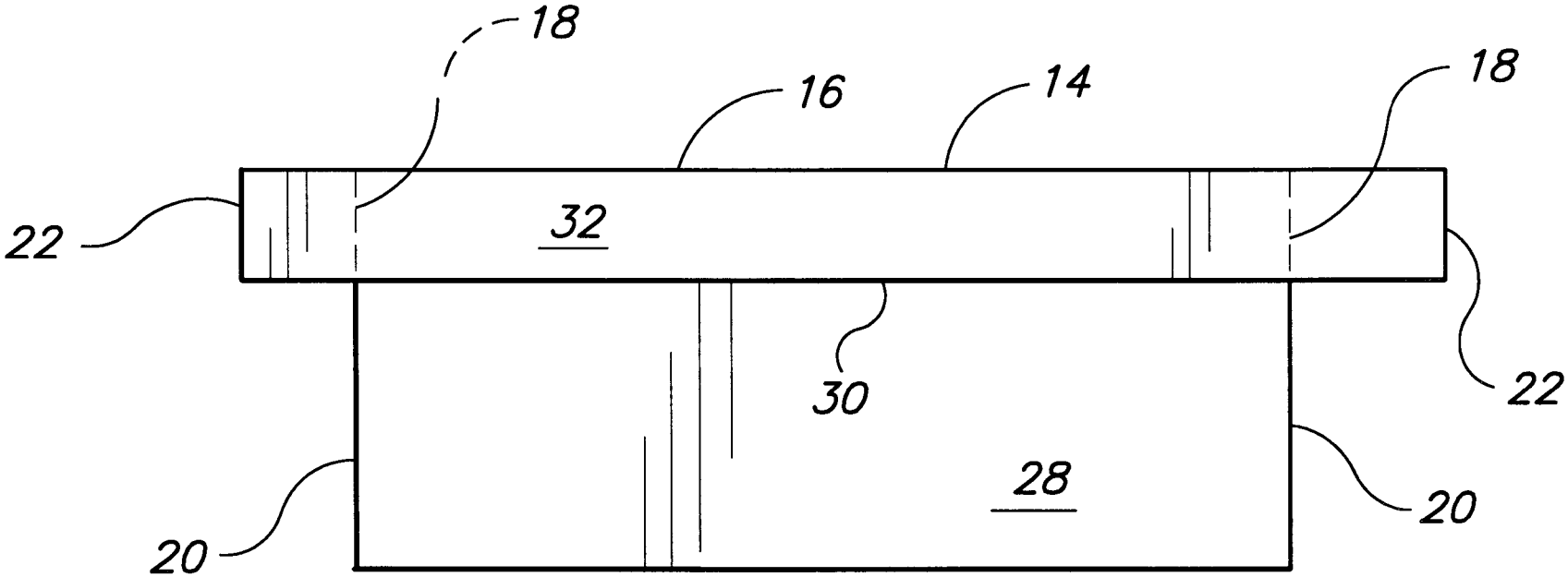
FIG. 4 is a plan view of the tool of FIG. 1.

Referring to FIG. 1 of the drawings, the present invention relates to a spacing and checking gauge 10 for use in determining edge setback distances for molding and trim around the peripheries of doors, windows and the like in building construction and for checking same. Gauge 10 is formed of a single component with two plates 12 and 14 extending from a common right-angled edge 16. Plate 14 has notches 18 having stepped faces 19 at either end of plate 14, each extending from corner faces 20 to common right-angled edge 16. FIG. 1 shows gauge 10 as it would be temporarily installed on a frame F in order to determine the proper edge setback for any molding or trim which may be installed. Frame F could be that of a door or window to which decorative molding, trim or the like is applied. Frame F has joints J interconnecting various members such as vertical member V and lintel L, with angles A of 90 degrees.

As shown in FIGS. 1–4, first plate inner surface 28 is placed flush against the inner surface S of frame F, and slid upward along vertical member V until one corner face 20 of gauge 10 contacts the inner surface of lintel L. Second plate inner surface 30 contacts inner edge I of frame F. Setback corner 34 may then be marked on Frame F. Vertical member reveal 36 may be marked along set back edge 32. Also, the desired lentil reveal 38 may be marked along spacing edge 24. Trim may then be installed according to these marks. Notches 18 may be of equal length, i.e., the distance between corner face 20 and spacing edge 22, but are preferably of differing lengths so additional sizes of reveal may be marked or checked by the same tool. The thickness of notches 18 provide an additional reveal checking or marking spacing and are about half the thickness of second plate 14 and extend beyond corner faces 20 for the total distance of the length of notches 18. The inner ends of notches 18 are formed by corner faces 20.

Figure 5:
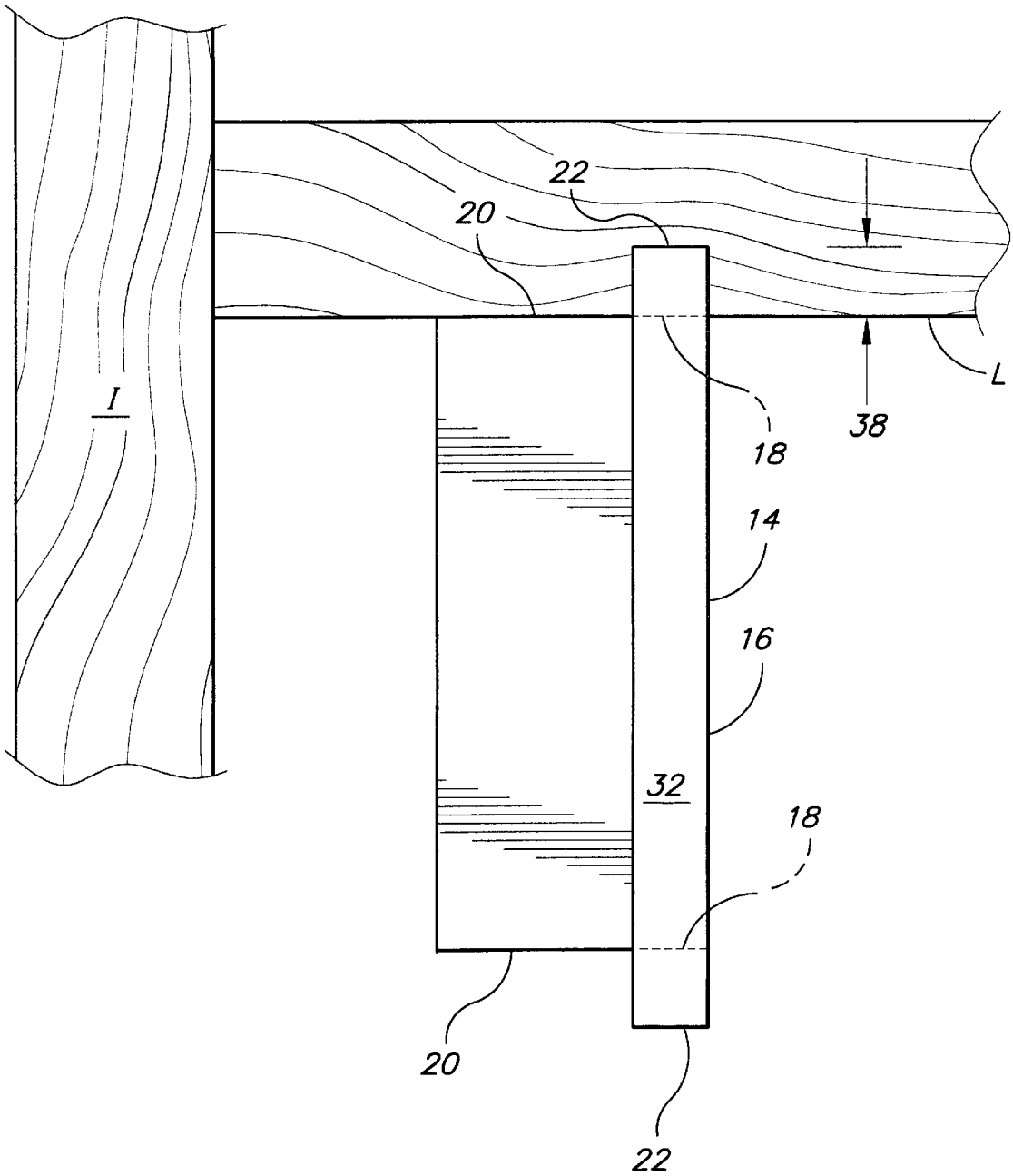
FIG. 5 is an environmental elevation view of the present invention shown marking a reveal along the length of a lentil.

As seen in FIG. 5, the reveal 38 on lentil L may be accurately checked along its length by rotating tool 10 and placing corner edge 20 along lentil L and checking the reveal by spacing edge 22. The reveal 38 may be then accurately marked or checked at any point along the lentil by sliding corner edge 20 along the inner edge of lentil L. Notch 18 allows corner edge 20 to fully engage inner edge L, providing good squareness support therealong for checking reveal 38 by spacing edge 22 at any desired point along lentil L.

The inventive tool may be made of any desired material, but a plastic material is preferred for lightness and low cost. The spacing between corner edges 20 and their respective spacing edges 22 are preferably about 5/16 inch and 7/16 inch, respectively, but other sizes are contemplated by the invention. The thickness of the notch 18 is preferably about ¼ inch and that of plate 14 about ½ inch. Several of the inventive tools, each having different reveal dimensions may be easily carried by a carpenter.

It is to be understood that the present invention is not limited to the embodiment described above, but encompasses any and all embodiments within the scope of the following claims.

I claim:

1. A reveal marking, positioning and checking tool for finish carpentry comprising:

a) a first plate and a second plate formed as a single unit;

b) each said first and said second plate respectively having an inner and an outer surface separated by a 90 degrees angle, and a common edge therebetween;

c) said first plate having two corner edges extending from said common edge;

d) said second plate having a setback edge opposite said common edge and two spacing edges therebetween;

e) at least one said spacing edge and said setback edge having a common corner defining a setback corner; and f) said second plate having a notch defined by each said corner edges, said spacing edges, and said second plate outer surface, forming a notch stepped surface, wherein said notch stepped surface is located at a point half the distance of between said common edge and said setback edge;

whereby said gauge is placed upon a framed opening having a frame joint and a frame edge periphery with one said first plate corner edge abutting said frame joint and said gauge common edge positioned along said frame edge periphery with said setback corner defining an inner corner for marking a reveal.

2. The gauge of claim 1, wherein said spacing edge and said setback edge define innermost edges for the positioning of molding and trim for installation on said frame.

3. The gauge of claim 1, wherein said spacing edge and said setback edge form an angle of 90 degrees.

4. The gauge of claim 1, wherein said spacing edge and said setback edge each respectively define a trim setback distance and said spacing edge trim setback distance and said setback edge trim setback distance are equal.

5. The gauge of claim 1, wherein each said spacing edge provides equal spacing edge trim setback distances.

6. The gauge of claim 1, wherein said spacing edges provide unequal spacing edge trim setback distances.

7. The gauge of claim 1, wherein the inner edge of said notch stepped surface defines an extension of said corner edge.

8. The gauge of claim 1, wherein the distances between each said corner edge and said corresponding spacing edge are about 5/16 and 7/16 inches, respectively.

9. The gauge of claim 8, wherein the distance between notch stepped surface and said set back edge is about ¼ inch.

* * * * *